US006348897B1

(12) United States Patent
Alameh et al.

(10) Patent No.: US 6,348,897 B1
(45) Date of Patent: Feb. 19, 2002

(54) MULTI-FUNCTION ANTENNA SYSTEM FOR RADIO COMMUNICATION DEVICE

(75) Inventors: Rachid M. Alameh, Crystal Lake, IL (US); Eric L. Krenz, Crystal Lake, IL (US); Thomas E. Gitzinger, Jr., Cincinnati, OH (US); Christopher S. Gremo, Algonquin, IL (US); Andrew A. Efanov, Crystal Lake, IL (US); Ji Chen, Lake in the Hills, IL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/788,197

(22) Filed: Feb. 16, 2001

(51) Int. Cl.[7] ..... H01Q 1/24
(52) U.S. Cl. ..... 343/702
(58) Field of Search ..... 343/702, 895, 343/700 MS; 455/90

(56) References Cited

U.S. PATENT DOCUMENTS

| | | | | |
|---|---|---|---|---|
| 5,572,223 A | | 11/1996 | Phillips et al. | 343/702 |
| 5,809,433 A | | 9/1998 | Thompson et al. | 455/575 |
| 5,943,021 A | | 8/1999 | Hayes et al. | 343/702 |
| 5,995,052 A | * | 11/1999 | Sadler et al. | 343/702 |
| 6,016,125 A | | 1/2000 | Johansson | 343/702 |
| 6,025,816 A | | 2/2000 | Dent et al. | 343/895 |
| 6,163,302 A | | 12/2000 | Björkengren | 343/702 |

* cited by examiner

*Primary Examiner*—Don Wong
*Assistant Examiner*—Hoang Nguyen
(74) *Attorney, Agent, or Firm*—Brian M. Mancini

(57) ABSTRACT

A multi-function antenna system for a radio communication device includes a housing that encloses a radio frequency transceiver of the radio communication device. A mounting base is coupled to the housing and has a first set of electrical contacts coupled to the transceiver. An antenna element is coupled by a hinge to the mounting base and has a second set of electrical contacts. Different portions of the first and second set of contacts are connectable as a function of the relative positions of the mounting base and the antenna element so as to provide different antenna functions.

21 Claims, 6 Drawing Sheets

MULTI-FUNCTION ANTENNA SYSTEM FOR RADIO COMMUNICATION DEVICE

FIELD OF THE INVENTION

The present invention relates generally to radio antennas, and more particularly to an antenna for radio communication devices.

BACKGROUND OF THE INVENTION

The size of wireless handheld communication devices, such as cellular telephones, is being driven by the marketplace towards smaller and smaller sizes. Consumer and user demand has continued to push a dramatic reduction in the size of communication devices. As these devices become less bulky, users face an increasing number of options for carrying and using the device. For example, early cellular telephones were so large and heavy that they could not comfortably be carried in a pocket or on a belt holster. It is envisioned that future portable devices will be thin and light enough to be easily carried in a shirt pocket or worn like a badge. However, the operation of such small devices in close proximity to a user affects the radio frequency transmission and reception qualities of the device. Moreover, such devices will still need to properly operate over multiple frequency bands and with various existing cellular system operating modes, such as TDMA, CDMA, GSM and even future operating systems.

Prior art antenna systems have utilized an extendable antenna shaft and various passive couplings to coils and capacitances to achieve an improved impedance match for the communication device to properly operate at various frequencies. Unfortunately, these systems are still relatively bulky when considering a phone that will be reduced to a credit-card size. In particular, placing a loading coil around a shaft while keeping the shaft mechanically rugged for a small phone would be difficult to achieve. Moreover, due to the thinness of a credit-card sized phone (about 5 mm), any extendable antenna shaft would necessarily be placed very close to the skin of a user during operation, compromising antenna efficiency and specific absorption rate (SAR) of the RF signal. Other prior art systems, such as planar inverted F antennas (PIFAs) have been used to provide dual band operation, but these systems do not provide the complete functionality required for smaller telephones. Conventional monopole antennas will not satisfy efficiency and SAR requirements in a shirt pocket position (the probable preferred user position for a thin-profile phone). However, an extended monopole antenna would provide more satisfactory performance when used by a user's head, due to the maximized distance between the radiating currents and the user's head and hand. Therefore, a conventional monopole will not satisfy the performance and safety requirements of cellular telephone operation when located at both a user's head and in a user's shirt pocket.

The need for enhanced operability of future communication devices along with the drive to smaller sizes results in conflicting technical requirements for the antenna. Impedance match, radiation efficiency, and minimum RF exposure to the user dictates different antenna solutions and implementation schemes for different operating modes. Further, the location of the device on a user during operation changes these parameters. For example, the smallness of the device may result in the entire device being shielded within a user's hand reducing radiation efficiency when not using an extendable antenna. In addition, the device must meet more stringent mechanical requirements in a manner that is sufficiently rugged. In particular, smaller devices are susceptible to flex stresses that can occur when carrying the device in a wallet, purse, pants pocket or shirt pocket during even mild user activities such as bending, walking, and sitting.

Accordingly, what is needed is an antenna system for a radio communication device that is mechanically rugged. It would also be of benefit, to provide an antenna system that is operable in very different antenna modes required for very different antenna states. Moreover, it would be an advantage to provide proper operation of the device in different operating positions with minimum complexity.

DETAILED DESCRIPTION OF THE PREFERRED EMBODIMENTS

Figure 1:
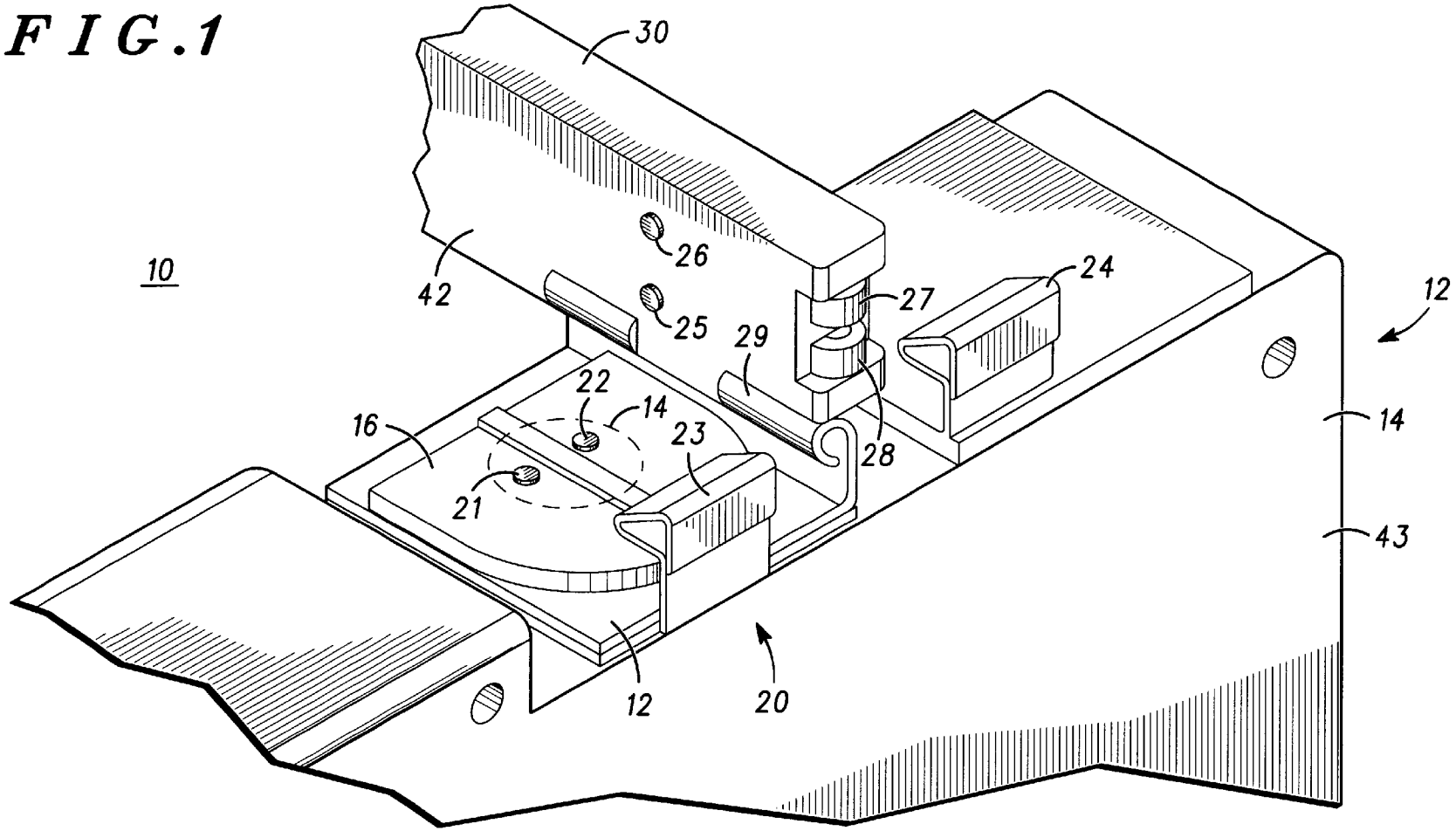
FIG. 1 is a perspective view of mechanical portion of an antenna system for a radio communication device, in accordance with the present invention.

The present invention provides an antenna system for a radio communication device configured to provide different function in different positions. A multi-contact, multi-function antenna with a hinged and rotating mount designed for a credit-card size phone is described below. The apparatus enables the antenna to operate in different modes such as a monopole or a PIFA depending on the position of the antenna and the way the phone is carried or held by the user. These modes include phone operation near the head or remotely in a shirt pocket, for example. The antenna mode and function is selected as the antenna is moved or rotated.

As portable communication technology has advanced, antenna efficiency and electromagnetic exposure has become an issue, particularly in two-way (transmit) handheld wireless communication products. Smaller, hand-held, wireless communication products are demanded by the market and meeting antenna efficiency and electromagnetic exposure requirements are more difficult. The present invention advantageously provides increased antenna efficiency while also decreasing electromagnetic exposure to a user. In addition, this invention allows products to be reduced in size without compromising performance.

The invention will have application apart from the preferred embodiments described herein, and the description is provided merely to illustrate and describe the invention and it should in no way be taken as limiting of the invention. While the specification concludes with claims defining the features of the invention that are regarded as novel, it is believed that the invention will be better understood from a consideration of the following description in conjunction with the drawing figures, in which like reference numerals are carried forward. As defined in the invention, a radiotelephone is a communication device that communicates information to a base station using electromagnetic waves in the radio frequency range. In general, the radiotelephone is portable and, when used, is typically held up to a person's head, next to their ear, or is operable in a pocket with a remote earpiece for the user.

The concept of the present invention can be advantageously used on any electronic product requiring the transceiving of RF signals. Preferably, the radiotelephone portion of the communication device is a cellular radiotelephone adapted for personal communication, but may also be a pager, cordless radiotelephone, or a personal communication service (PCS) radiotelephone. The radiotelephone portion may be constructed in accordance with an analog communication standard or a digital communication standard. The radiotelephone portion generally includes a radio frequency (RF) transmitter, an RF receiver, a controller, a battery, filters, a frequency synthesizer, a signal processor, and a user interface including at least one of a speaker or earpiece, keypad, display, control switches, and a microphone. The radiotelephone portion can also include a paging receiver. The electronics incorporated into a cellular phone, two-way radio or selective radio receiver, such as a pager, are well known in the art, and can be incorporated into the communication device of the present invention.

Many types of radio communication device can use the antenna system of the present invention to advantage. By way of example only, the communication device is embodied in a cellular phone having a conventional cellular radio transceiver circuitry, as is known in the art, and will not be presented here for simplicity. The cellular telephone, includes conventional cellular phone hardware (also not represented for simplicity) such as processors and user interfaces that are integrated in a compact housing, and further includes an antenna system, in accordance with the present invention. Each particular wireless device will offer opportunities for implementing this concept and the means selected for each application. It is envisioned that the present invention is best utilized in a credit card sized phone as represented in the figures below. For example, such a phone would have a volume of 24 cc with an overall thickness of about 5 mm (including battery) and employ a metal housing for maximum rigidity.

A series of specific embodiments are presented, ranging from the abstract to the practical, which illustrate the application of the basic precepts of the invention. Different embodiments will be included as specific examples. Each of which provides an intentional modification of, or addition to, the structure of the communication device for the purpose of providing antenna radiation efficiency for different operating functions and modes while diverting RF currents away from dissipating media such as the user's head, limb or body.

FIG. 1 shows a multi-function antenna system 10 for a radio communication device 12, in accordance with the present invention. The antenna system 10 comprises a housing 14, a mounting base 20, and an antenna element 30. The housing 14 encloses a radio frequency transceiver (not shown) of the radio communication device 12. The transceiver circuitry operates in any of the well known modes of operation for radio transceivers, such as a GSM or PCS cellular telephone system. A mounting base 20 is mechanically coupled to the housing 14. The mounting base 20 has a first plurality of electrical contacts 21,22,23,24 disposed thereon that are electrically coupled to the transceiver. Although two base contacts 21,22 are shown, only one of these contacts is necessary along with ground contact 23 and terminal 24. It should be noted that the number of contacts depends on a particular embodiment). An antenna element 30 is mechanically coupled to the mounting base 20 by a hinge 29. A second plurality of electrical contacts 25,26,27, 28 is disposed on the antenna element 30. Although two pin contacts 25,26 are shown, only one of these contacts is necessary along with only one of the end contacts 27,28. Different portions of the first and second plurality of contacts 21–28 are electrically connectable as a function of the relative positions of the mounting base 20 and the antenna element 30 so as to provide different functions. It should also be recognized that the hinge can be used as an electrical connection where further connections or more conductive traces are used.

Figure 2:
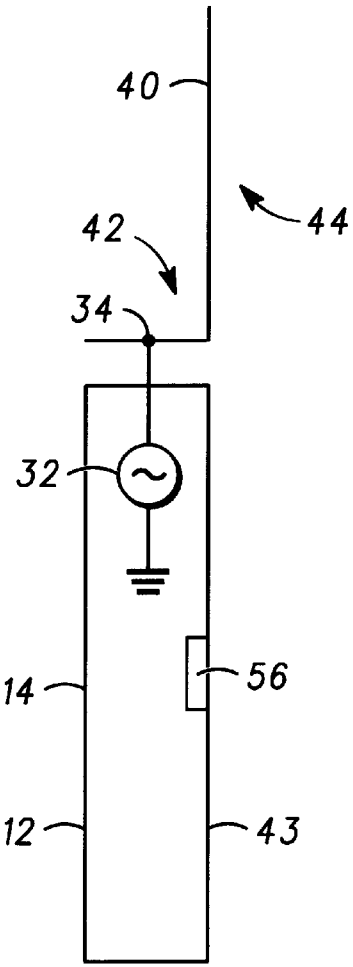
FIG. 2 is a representational side view of a radio communication device with the antenna system of FIG. 1 in a first position.

In its most basic embodiment (and refering to FIGS. 1–3), the antenna element includes at least one conductive trace 40 (not shown in FIG. 1) disposed on or in the antenna element. The antenna element itself can be of any non-conductive material such as plastic, polymer or ceramic, or have an insulating portion substantially surrounding the conductive trace. Preferably, the substrate of the antenna element is of a very flexible material, such as an elastomer or polyimide for example, to avoid breakage during use. The conductive trace can be a wire, transmission line, microstrip, foil trace, or any other conductive type of material disposed on the antenna element. The antenna element 30 has a first position (FIG. 2) that engages a first electrical connection between the mounting base 20 and antenna element 30 such that the at least one conductive trace functions as a first antenna type with the antenna element 30 substantially extended away from the housing 14, and the antenna element 30 has a second position (FIG. 3)that engages a second electrical connection between the mounting base 20 and the antenna element 30 such that the at least one conductive trace functions as a second antenna type with the antenna element located substantially coplanar and equidistant from a face of the housing 14.

In particular, the conductive trace 40 has a short portion 42 and a long portion 44 in a substantially L-shape with the short portion 42 extending sideways and substantially perpendicular to a major face 43 of the housing 14 and the long portion 44 extending substantially parallel to the major face 43 of the housing 14. More particularly, the antenna element 30 and mounting base 20 have a first (extended) position (FIG. 2) that engages a first electrical connection between the mounting base 20 and (conductive trace of the) antenna element 30, with the short portion 42 of the (conductive trace of the) antenna element extending perpendicular to a major face 43 of the housing 14 and the long portion 44 of the (conductive trace of the) antenna element 30 extending parallel to the major face 43 of the housing 14 and away from the housing, and the antenna element 30 and mounting base 20 have a second (clip) position (FIG. 3) that engages a second electrical connection between the mounting base 20 and the antenna element 30 with the short portion 42 of the antenna element 30 extending perpendicular to a major face 43 of the housing 14 and the long portion 44 being parallel and being substantially equidistant from the major face 43 of the housing 14. FIG. 1 demonstrates the antenna element in an intermediate position between the first and second positions.

It should be recognized that more contacts and traces can be added to the antenna element such as are used in a PIFA arrangement or in a multiple band antenna. In FIG. 1, the pairs of contacts 21,22 and 25,26 along with 27,28 can be used to connect antenna arrangements operable over two different frequency bands such as GSM and PCS, for example. Contacts 25 and 28 are electrically coupled together and contacts 26 and 27 are electrically coupled together. Contact 23 is connected to ground through the metal housing 14. Therefore, in FIGS. 1 and 2, contact 28 can be a signal contact 34 for a GSM antenna, for example, while the antenna element 30 is in the first position, i.e. where contacts 28 and 24 connect. Clip 24 would also serve to capture and retain the antenna element in the first position. Contacts 27 and 24 would also connect a signal for a second (PCS) antenna. The transceiver 32 can then excite either of the desired antennas and trap the other antenna using circuitry known in the art.

Figure 3:
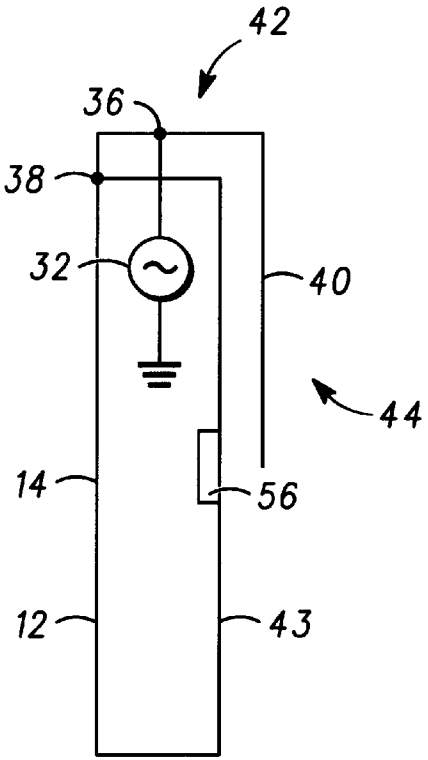
FIG. 3 is a representational side view of a radio communication device with the antenna system of FIG. 1 in a second position.

Correspondingly, in FIGS. 1 and 3, contact 21 can be a signal contact 36 for a PCS antenna, for example, while the antenna element 30 is in the second position, i.e. where contacts 21 and 26 abut one another. Contact 27 and ground clip 23 would also connect to form a ground connection 38. Clip 23 would also serve to capture and retain the antenna element in the second position. Contacts 22 and 25 would also abut and connect a signal for a GSM antenna (along with a ground connection between contact 28 and ground clip 23. The transceiver 32 can then switchably connect to either of the desired antennas using passive or active switching as is known in the art.

In practice, the antenna element in the first position engages a first electrical connection between the mounting base and antenna element such that the at least one conductive trace functions as first antenna type such as a one quarter-wave monopole. In a second position, the antenna element engages a second electrical connection between the mounting base and the antenna element such that the same at least one conductive trace functions as a second antenna type such as a planar inverted F antenna.

Figure 4:
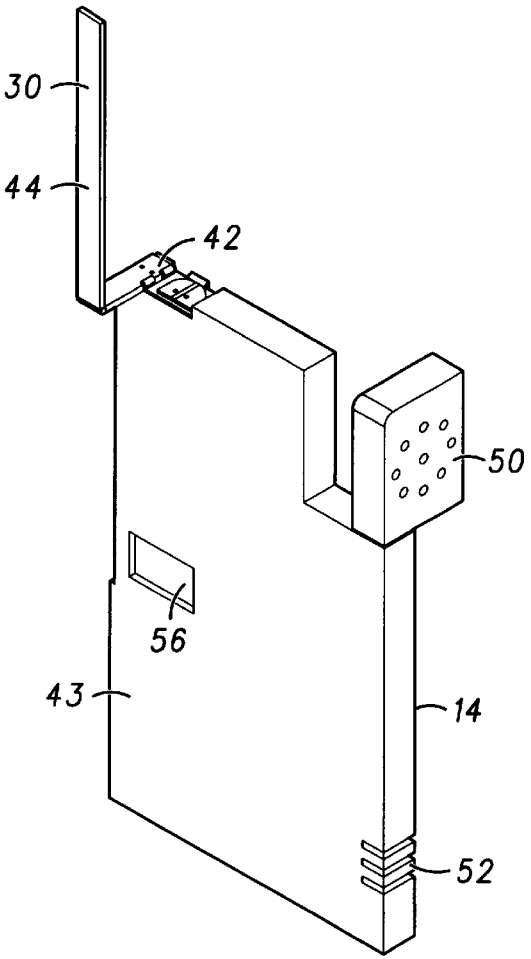
FIGS. 4–6 are perspective views of first, second and third positions, respectively, of the antenna system of the present invention, in relation to a radiotelephone.
Figure 5:
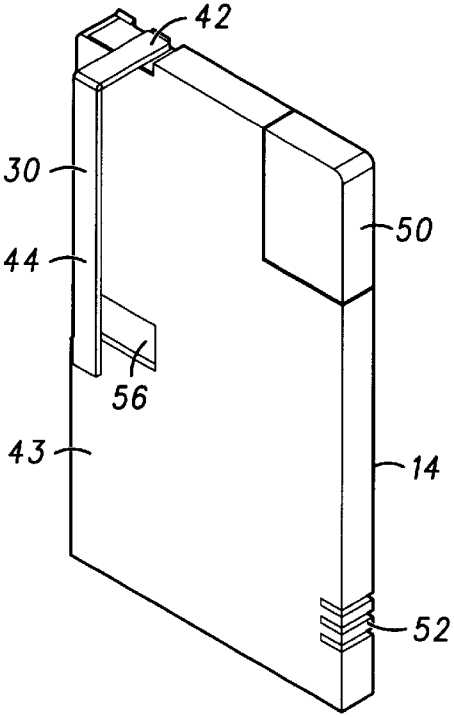

FIG. 4 shows the communication device with the antenna system in the first (extended) position implementation. In the extended position, no part of the conductive pattern on the antenna element would be connected to ground, and one or more contacts between the conductive trace of the antenna element would be made to the radio transceiver. The antenna element would thus be driven against the radio chassis in a conventional monopole mode of operation. It is also possible to have part of a switchable matching network on the antenna structure. These matching components would only be in the circuit in one antenna state or the other, so that impedance match changes could be accomplished without the need for active switching devices. The extended position provides best efficiency performance when used against the head rather than when worn on a user's person, such as in a shirt pocket. Communication and safety can be enhanced via a rotatable speaker accessory 50 connected to the device. In this way, the user can place an edge of phone with the speaker 50 and microphone 52 against their head while keeping the antenna structure away from the head. This leads to reduced electromagnetic radiation dissipation in a user, and consequently reduced specific absorption rate (SAR) and increased radiation efficiency in the presence of the user FIG. 5 shows the communication device with the antenna system in the second (clip) position implementation. In this clip position, one contact would be made between part of the conductive trace on the antenna element and the ground (chassis) of the credit card phone, and one or more additional connections to the antenna element's conductive pattern(s) would be made to the radio transceiver to feed the inverted F in the conventional manner. The number of signal connections would depend on the specifics of operation, i.e., whether the antenna is to be a single-band or dual-band structure.

In this position, the antenna element is located in a position at a distance from the device. It is envisioned that the device could then be worn and operated in a user's pocket, with the antenna being outside of the pocket in front of the user. This clip position spaces the antenna away from the housing and the user's body while carrying the phone in a shirt pocket or in a necklace type application. The clip-position antenna serves a multifunction role. It is a visual indication to the user to point the antenna away from the body while operational, it provides a mechanical holding function to clip the phone to the shirt pocket, and it can provide a hook switch function for the phone as will be explained below. In the clip-position mode, the antenna rotates to the back of the phone so that it does not obstruct the user's view of a display (not shown) on one face 54 of the device, and if carried in a shirt pocket a user can look into their pocket and see the display. The clip mode is intended to be the main mode of operation for a credit card sized phone. Communication can be enhanced via a removable earbud speaker accessory 50 that is connected to the device while in the shirt pocket. For example, the speaker accessory 50 could be removable from the device with a wired or wireless connection to the device. In a wired embodiment, a mini-RCA type plug and jack can be used to connect the speaker to the device.

Figure 6:
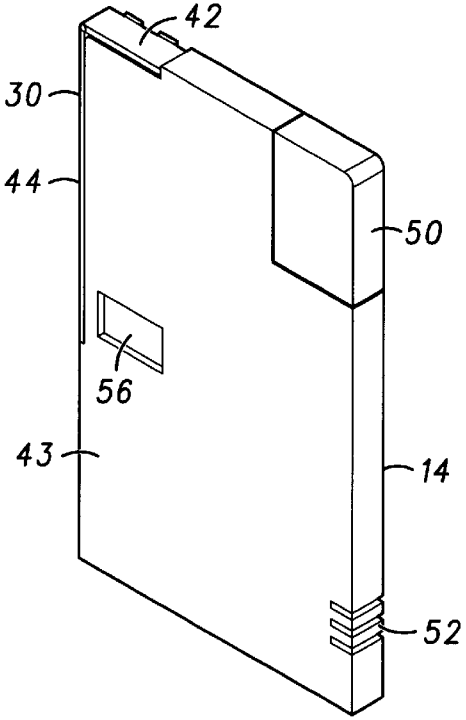

FIG. 6 shows the communication device with the antenna system in the third (stowed) position implementation, wherein the antenna element is fully collapsed into a fully protected position in close proximity to an edge of the housing of the device. The stowed position is meant for transportation of the phone such as in a purse or wallet. In this mode, the phone can be disabled from transmitting or receiving calls. This can be accomplished by having the transceiver disabled, such as turning of the RF power amplifier (PA). Optionally, there will be a sensing scheme or detector 56 in the device housing (such as a contact, switch, a proximity detector, or possibly a detection method to sense the change of impedance of the antenna) to shut down the PA when the antenna element is in a stowed position in proximity to the detector. When the antenna element is deployed from the stowed position to the second clip position, for example, the detector can no longer sense the proximity of the antenna element an enables the transceiver by turning on the RF PA which enables the device to receive and transmit. Alternatively, the detector can be extra contacts placed on the mounting base, to detect and turn on the transceiver when the antenna is engaged in the extended or clip positions, or the detector can detect and turn off the transceiver when the antenna is in any other position, such as stowed or between positions.

It is important to note that the user will still be able to access the phone in this stowed state, thus allowing access to the phonebooks, email, download data via an electronic port, or other applications that may be running on the phone. By having the stowed position, the phone can be carried in a wallet or back pocket without the fear of the antenna being damaged. Preferably, the antenna element is stowed completely within the phone housing, with no extending parts for maximum protection. In addition, since the phone cannot send or receive calls in this position, there is no electromagnetic exposure to a user.

In the stowed embodiment, it is necessary that the mounting base of the antenna element pivots so as to provide a third position for the antenna element that electrically disengages the antenna element from the transceiver. In particular, and referring to FIG. 1, the mounting base includes a fixed portion 16 that holds the electrical contacts 21,22 stationary, and a pivoting portion 12 that can pivot under the fixed portion 16 around a mounting axis 14 such as a slip fit collar joint. This removes contacts 25,26 from possibly touching contacts 21,22. More particularly, the mounting base 20 pivots such that the edge of short portion 42 of the antenna element 30 is rotated from being parallel to the major face 43 of the housing 14 to being perpendicular to the major face 43 of the housing 14 when the antenna element 30 is moved from the third position to the second position. It is also desired that the antenna element 30 is not originally in the first position by first being rotated one-hundred-eighty degrees about an axis of the short portion 42 of the antenna element 30 when the antenna element is moved from the second position to the first position. In this way, direct movement from the first to third position would be disallowed.

In its simplest form, the antenna system can incorporate a single conductive trace disposed on the antenna element. Two or more conductive traces can be provided for multi-frequency operation. This would utilize passive or active switching in the radio communication device for proper operation. One conductive trace operates as a simple quarter-wave monopole when the antenna is extended in its first position, but suffers performance in the second clip position. Therefore, a preferred embodiment of the present invention employs a planar inverted-F antenna (PIFA) mode of operation in the clip position, and a quarter-wave monopole mode of operation in the extended position. The choice of a PIFA for the clip mode is based on making maximum use of the long narrow clip in proximity to the metal housing. The choice of a simple monopole (which need not be covered here) for the extended position is based on moving the radiated currents as far as possible from the user's head and hands.

Figure 7:
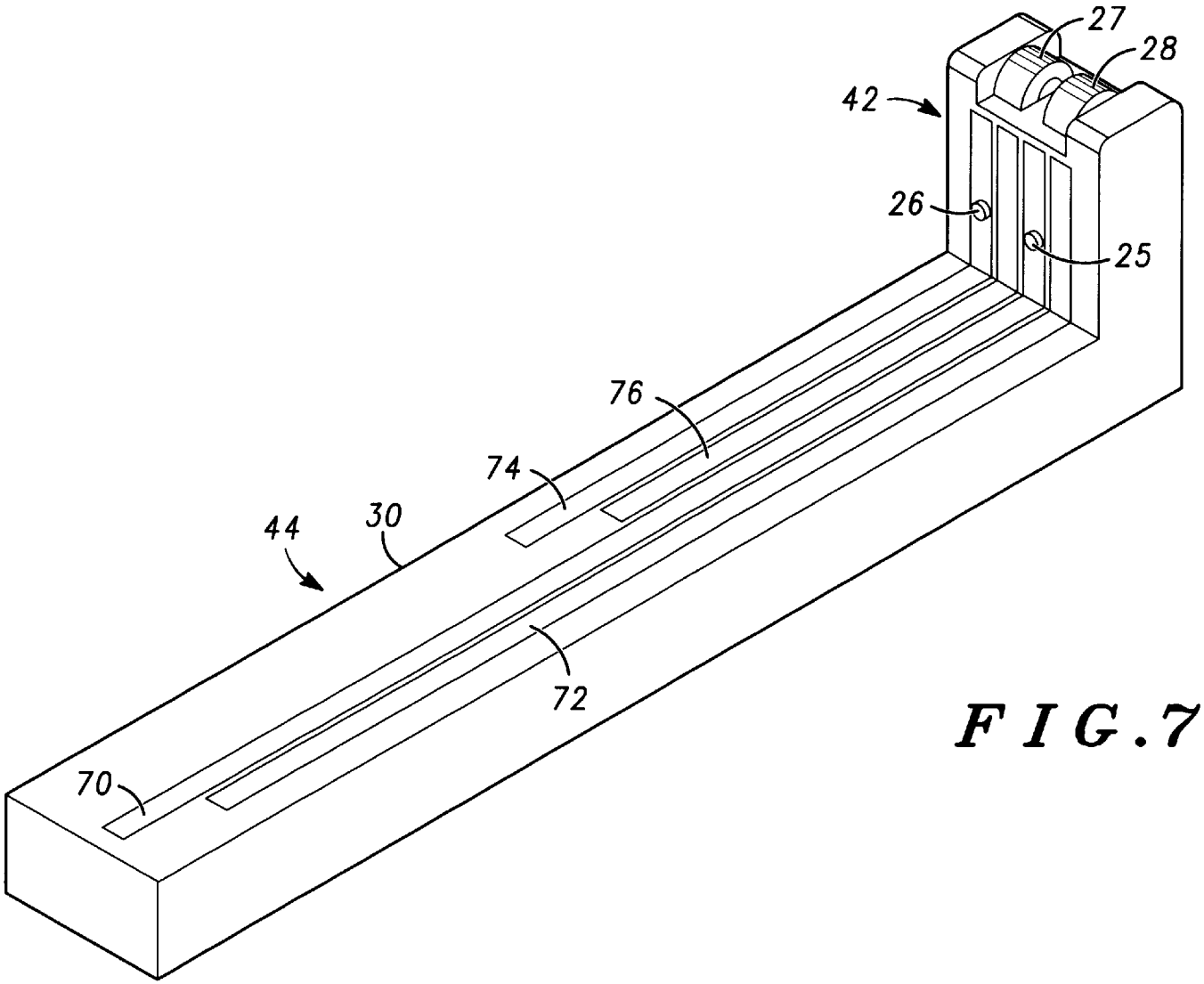
FIG. 7 is a perspective view of a planar inverted F antenna embodiment, in accordance with the present invention.

As shown in FIG. 7, a PIFA system utilizes conductive traces 70,74 and parasitic traces 72,76 disposed on the antenna element 30. In particular, the antenna element 30 includes at least one parasitic conductive trace adjacent to the at least one conductive trace. Optionally, the at least one parasitic conductive trace is switchably connected to the first plurality of electrical contacts depending on a position of the mounting base. In a first embodiment, all the ends of elements 70,72,74,76 are commonly connected (not shown) to contacts 27,28 at the short portion 42 of the antenna element 30. In a second embodiment, traces 74,76 are commonly connected with contact 27 and traces 70,72 are commonly connected with contact 28. Alternatively, the parasitic traces can have individual contacts that can be switchably connected depending on the relative position of the antenna element and mounting base. Further, the hinge can serve as an electrical contact for either or both of the traces and parasitic traces, such as a ground connection for example.

For the clip position, a PIFA that supports both GSM and PCS-band operation has been investigated. It has a long potion (length) of 68 mm, a short portion (height) of 10 mm, and a width of 5 mm. In this position, the 10 mm height defines the distance of the conductive traces on the long portion of the antenna element from the metal housing of the communication device. In order to get the required bandwidth with this configuration, an arrangement of pairs of PIFA elements for each band has been investigated. For each band, one driven element 70 (74) and one parasitic element 72 (74) of slightly different lengths are positioned side-by-side. The parasitic element has one end grounded, but no direct feed connections. The driven element has one end grounded and a feed probe in the conventional manner (see FIG. 3). The lengths of the two elements and the coupling (dependent on spacing) between them, in conjunction with the coupling with the metal housing, are adjusted to place one resonance on the transmit sub-band and one on the receive sub-band. Although simulation has shown that this technique can support the required bandwidth at PCS frequencies, some transceiver switching of the antenna structure can be utilized to optimize coverage for the GSM band. This can be accomplished by selectively shorting or not shorting the parasitic element to ground, effectively taking it out of the circuit and shifting the resonance frequency or frequencies observed at the input of the driven element.

Figure 9:
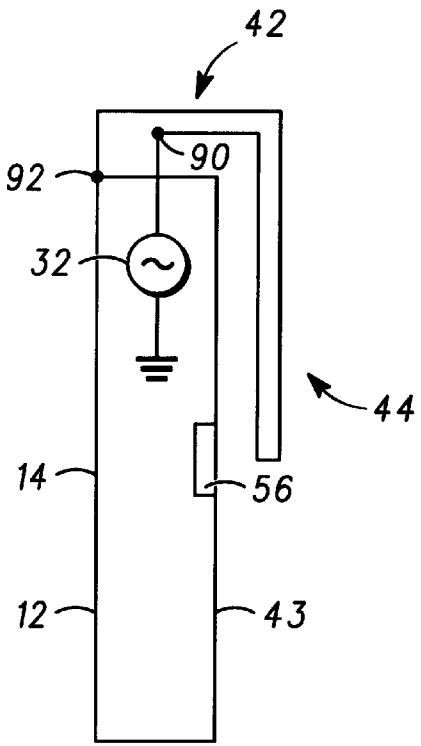
FIG. 9 is a representational side view of an alternate embodiment of a radio communication device with the antenna system of FIG. 1 in a second position.
Figure 8:
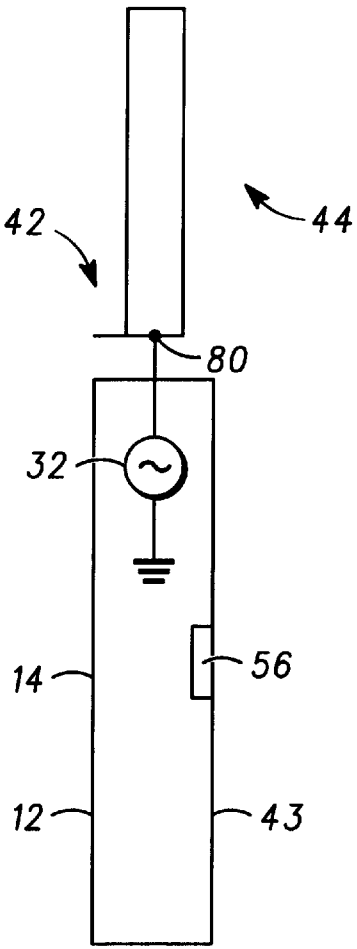
FIG. 8 is a representational side view of an alternate embodiment of a radio communication device with the antenna system of FIG. 1 in a first position.

In an alternate embodiment of the present invention, as shown in FIGS. 8 and 9, the antenna system uses a u-shaped quarter wave monopole structure for both the first (extended) and second (clip) positions, respectively. In the clip position, one leg of the folded structure will be the signal contact (feed) and the other leg will be connected to the ground (chassis) to form a folded monopole. In the extended position, both the legs will be connected together and driven against the chassis to form a simple monopole. More particularly, in the extended position of the alternate embodiment (FIG. 8 and referring to FIG. 1), the antenna element 30 and mounting base 20 engage a first electrical connection between the mounting base 20 and (conductive trace of the) antenna element 30, with the short portion 42 of the (conductive trace of the) antenna element extending perpendicular to a major face 43 of the housing 14 and the long portion 44 of the (conductive trace of the) antenna element 30 extending parallel to the major face 43 of the housing 14 and away from the housing. In the clip position of the alternate embodiment (FIG. 9 and referring to FIG. 1), and the antenna element 30 and mounting base 20 engage a second electrical connection between the mounting base 20 and the antenna element 30 with the short portion 42 of the antenna element 30 extending perpendicular to a major face 43 of the housing 14 and the long portion 44 being parallel and being substantially equidistant from the major face 43 of the housing 14.

Figure 10:
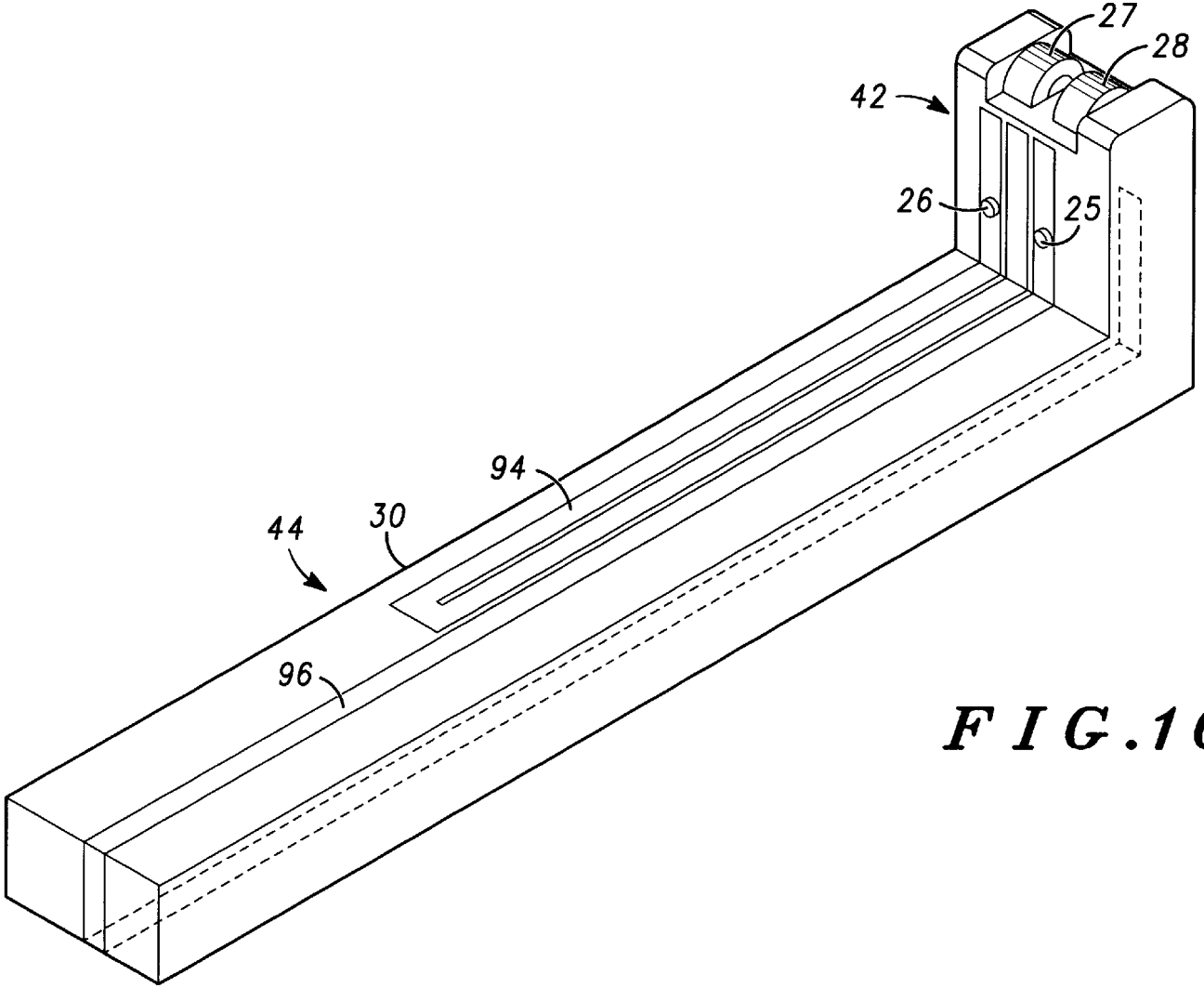
FIG. 10 is a perspective view of a folded quarter-wave antenna embodiment, in accordance with the present invention.

It should be recognized that more contacts and traces can be added to the antenna system for multiple band arrangement. In FIG. 1, the pairs of contacts 21,22 and 25,26 along with 27,28 can be used to connect antenna arrangements operable over two different frequency bands such as GSM and PCS, for example. As shown in FIG. 10, contacts 25 and 28 are at either end of a u-shaped monopole for one band, and contacts 26 and 27 are at either end of another u-shaped monopole for another band. Contact 23 is connected to ground through the metal housing 14. Therefore, in FIGS. 1 and 8, contact 28 can be a signal contact 80 for a GSM antenna, for example, while the antenna element 30 is in the first position, i.e. where contacts 28 and 24 connect, and contact 25 is coupled to clip 24 through a further connection (not shown). Clip 24 would also serve to capture and retain the antenna element in the first position. Contacts 27 and 24 would also connect a signal for a second (PCS) antenna, along with the coupling of contacts 26 and 24 (not shown). The transceiver 32 can then excite either of the desired antennas and trap the other antenna using circuitry known in the art.

Correspondingly, in FIGS. 1 and 9, contact 21 can be a signal contact 90 for a PCS antenna, for example, while the antenna element 30 is in the second position, i.e. where contacts 21 and 26 abut one another. Contact 27 and ground clip 23 would also connect to form a ground connection 92. Clip 23 would also serve to capture and retain the antenna element in the second position. Contacts 22 and 25 would also abut and connect a signal for a GSM antenna (along with a ground connection between contact 28 and ground clip 23. The transceiver 32 can then switchably connect to either of the desired antennas using passive or active switching as is known in the art.

For operation in dual bands, such as for GSM and PCS for example, two similar structures of different resonant lengths will be used on the antenna element as shown in FIG. 10. The shorter portion 42 of the L section of both the GSM and the PCS antenna structures is approximately about 10 mm and defines the distance of the antenna from the chassis in the clip position. The longer portions 44 of the GSM antenna 96 have a length of about 62 mm, width of about 0.3 mm and the gap between the two folded arms is about 0.3 mm. The longer portions 44 of the PCS antenna 94 have a length of about 20 mm, width of about 1 mm and a gap of about 0.5 mm between them. These dimensions are applicable if the medium enclosing the antenna element 30 is air and will be different for different dielectrics.

The GSM and PCS antenna structures should be RF isolated from each other to reduce distortion of the PCS band operation by the GSM antenna structure. This is achieved by having maximum physical separation possible between the two antenna structures and having each loop of the antenna structures folded in substantially perpendicular planes as shown in FIG. 10. Although, the shorter element 94 is shown disposed on a surface of the element 30, and the longer antenna element 96 is shown as being disposed on a surface, and wrapped around an end, of the antenna element 30, it is to be understood that this configuration can be reversed such that the shorter element is wrapped around a side of the element or preferably embedded into a molded antenna element 30, and the longer element is on a surface of, or also embedded in, the antenna element. If the total width available for the entire antenna structure is about 5 mm, then the above dimensions ensure a separation of about 3.1 mm between the PCS and GSM antenna structures.

For the clip position, the folded antenna structures for the two bands will have separate feed points. Since the antenna structure is fed as a monopole over a ground, the return loss is poor. However, the Q of the impedance curve is low in this case and enables the use of two separate T matching networks (not shown) in the radio communication device for the GSM and the PCS bands to improve the return loss bandwidth of the antenna in the clip position. In the extended position, the antenna has good return loss bandwidth for both bands, and hence no matching circuit is necessary. Further, the feed point can be connected together and the antenna structures for both the bands can be driven at a single point against the ground.

The present invention advantageously provides entirely different antenna modes utilized in the two fully operational clip and extended positions. Switching between these modes is accomplished automatically as a result of the physical rotation of the antenna between, the clip position and the extended position. This is accomplished by having opposite faces of the L-shaped antenna element rest on two distinct areas of the top surface of the phone, depending on which position is selected. As a result, one surface is in contact with the phone in the clip position, and the opposite surface is in contact with a different area of the phone when in the extended position. Thus, different contact combinations are possible for the two positions, simply by placing different contact arrays on these two sides of the antenna and the two distinct areas on the top of the phone.

In summary, it should be recognized that the present invention is an improved antenna system. As such, its benefits apply to any sort of wireless radio communication system. A number of illustrations have been given showing application to cellular telephones, but the invention is equally applicable to other RF devices as are known in the art.

It is to be understood that the phraseology or terminology employed herein is for the purpose of description and not of limitation. Accordingly, the invention is intended to embrace all such alternatives, modifications, equivalents and variations as fall within the broad scope of the appended claims.

What is claimed is:

1. A multi-function antenna system for a radio communication device, the system comprising:

a housing that encloses a radio frequency transceiver of the radio communication device;

a mounting base that is mechanically coupled to the housing and has a first plurality of electrical contacts disposed thereon that are electrically coupled to the transceiver; and an antenna element mechanically coupled to the mounting base by a hinge, the antenna element having a second plurality of electrical contacts connected to at least one conductive trace disposed thereon, wherein different portions of the first and second plurality of contacts are electrically connectable as a function of the relative positions of the mounting base and the antenna element so that the at least one conductive trace provides different antenna functions.

2. The antenna system of claim 1, wherein the antenna element has a first position that engages a first electrical connection between the mounting base and antenna element such that the at least one conductive trace functions as a first antenna type with the antenna element extended substantially away from the housing, and the antenna element has a second position that engages a second electrical connection between the mounting base and the antenna element such that the at least one conductive trace functions as a second antenna type with the antenna element located substantially parallel and substantially equidistant from a face of the housing.

3. The antenna system of claim 2, wherein the first antenna type is a quarter-wave monopole antenna, and the second antenna type is a planar inverted F antenna.

4. The antenna system of claim 2, wherein the first antenna type is a folded quarter-wave monopole providing a simple monopole function, the second antenna type is a folded quarter-wave monopole providing a loop monopole function, and each loop of the first and second antenna type is folded in substantially perpendicular planes.

5. The antenna system of claim 2, wherein the mounting base also pivots so as to provide a third position for the antenna element that electrically disengages the antenna element from the transceiver, the third position stows the antenna element in close proximity to the housing.

6. The antenna system of claim 5, further comprising a detector in the device for detecting a stowed position of the antenna element, and wherein the detector disables the transceiver when the antenna element is stowed and enables the transceiver when the antenna element is deployed.

7. The antenna system of claim 2, wherein the antenna element includes a short portion and a long portion in a substantially L-shape, and wherein the first position includes the short portion of the antenna element extending substantially perpendicular to a major face of the housing and the long portion extending parallel to the major face of the housing and extending away from the housing, and the second position includes the short portion of the antenna element extending substantially perpendicular to a major face of the housing and the long portion being substantially parallel and substantially equidistant from the major face of the housing.

8. The antenna system of claim 7, wherein the mounting base also pivots such that the short portion of the antenna element is rotated from being parallel to the major face of the housing to being perpendicular to the major face of the housing when the antenna element is moved from the third position to the second position, and the antenna element is rotated one-hundred-eighty degrees about an axis of the short portion of the antenna element when the antenna element is moved from the second position to the first position.

9. The antenna system of claim 1, wherein the antenna element includes a short portion and a long portion in a substantially L-shape with the short portion extending sideways and substantially perpendicular to a major face of the housing and the long portion extending substantially parallel to the major face of the housing.

10. The antenna system of claim 1, wherein the antenna element includes at least one parasitic conductive trace adjacent to the at least one conductive trace, the at least one parasitic conductive trace being switchably connected to the first plurality of electrical contacts depending on a relative position of the antenna element and mounting base.

11. A multi-function antenna system for a radio communication device, the system comprising:

a housing that encloses a radio frequency transceiver of the radio communication device;

a mounting base that is mechanically coupled to the housing and has a first plurality of electrical contacts disposed thereon that are electrically coupled to the transceiver; and an antenna element mechanically coupled to the mounting base by a hinge, the antenna element having a second plurality of electrical contacts connected to at least one conductive trace disposed thereon, the antenna element and mounting base have a first position that engages a first electrical connection between the mounting base and antenna element such that the at least one conductive trace functions as a first antenna type with the antenna element substantially extended away from the housing, and the antenna element and mounting base have a second position that engages a second electrical connection between the mounting base an the antenna element such that the at least one conductive trace functions as a second antenna type with the antenna element located substantially parallel and substantially equidistant from a face of the housing.

12. The antenna system of claim 11, wherein the mounting base also pivots so as to provide a third position for the antenna element that electrically disengages the antenna element from the transceiver, the third position stows the antenna element in close proximity to the housing.

13. The antenna system of claim 12, further comprising a detector in the device for detecting a stowed position of the antenna element, wherein the detector disables the transceiver when the antenna element is stowed and enables the transceiver when the antenna element is deployed.

14. The antenna system of claim 11, wherein the antenna element includes a short portion and a long portion in a substantially L-shape, and wherein the first position includes the short portion of the antenna element extending substantially perpendicular to a major face of the housing and the long portion extending parallel to the major face of the housing and extending away from the housing, and the second position includes the short portion of the antenna element extending substantially perpendicular to a major face of the housing and the long portion being substantially parallel and substantially equidistant from the major face of the housing.

15. The antenna system of claim 14, wherein the short portion of the antenna element is rotated from being parallel to the major face of the housing to being perpendicular to the major face of the housing when the antenna element is moved from the third position to the second position, and the antenna element is rotated one-hundred-eighty degrees about an axis of the short portion of the antenna element when the antenna element is moved from the second position to the first position.

16. The antenna system of claim 11, wherein the antenna element includes at least one parasitic conductive trace adjacent to the at least one conductive trace, the at least one parasitic conductive trace being switchably connected to the first plurality of electrical contacts depending on a position of the mounting base.

17. A multi-function antenna system for a radio communication device, the system comprising:

a housing that encloses a radio frequency transceiver of the radio communication device;

a mounting base that is mechanically coupled to the housing and has a first plurality of electrical contacts disposed thereon that are electrically coupled to the transceiver; and an antenna element mechanically coupled to the mounting base by a hinge, the antenna element having a second plurality of electrical contacts connected to at least one conductive trace disposed thereon, the antenna element includes a short portion and a long portion in a substantially L-shape, the antenna element and mounting base have a first position that engages a first electrical connection between the mounting base and antenna element with the short portion of the antenna element extending perpendicular to a major face of the housing and the long portion extending parallel to the major face of the housing and away from the housing, and the antenna element and mounting base have a second position that engages a second electrical connection between the mounting base an the antenna element with the short portion of the antenna element extending perpendicular to a major face of the housing and the long portion being parallel and being substantially equidistant from the major face of the housing.

18. The antenna system of claim 17, wherein the antenna element and mounting base have a third position that disengages electrical connection between the mounting base an the antenna element with the antenna element being in close proximity to an edge of the housing.

19. The antenna system of claim 18, further comprising a detector in the device for detecting a stowed position of the antenna element, wherein the detector disables the transceiver when the antenna element is stowed and enables the transceiver when the antenna element is deployed.

20. The antenna system of claim 18, wherein the short portion of the antenna element is rotated from being parallel to the major face of the housing to being perpendicular to the major face of the housing when the antenna element is moved from the third position to the second position, and the antenna element is rotated is one-hundred-eighty degrees about an axis of the short portion of the antenna element when the antenna element is moved from the second position to the first position.

21. The antenna system of claim 17, wherein the antenna element includes at least one parasitic conductive trace adjacent to the at least one conductive trace, the at least one parasitic conductive trace being switchably connected to the first plurality of electrical contacts depending on a position of the mounting base.

* * * * *